United States Patent [19]

Katayama

[11] Patent Number: 4,492,094

[45] Date of Patent: Jan. 8, 1985

[54] ONE-BODY TYPE AIR CONDITIONER

[75] Inventor: Kaneo Katayama, Shizuoka, Japan

[73] Assignee: Mitsubishi Denki Kabushiki Kaisha, Tokyo, Japan

[21] Appl. No.: 505,498

[22] Filed: Jun. 17, 1983

[30] Foreign Application Priority Data

Jun. 30, 1982 [JP] Japan ..... 57-113541
Jul. 8, 1982 [JP] Japan ..... 57-103523[U]
Jul. 8, 1982 [JP] Japan ..... 57-118932

[51] Int. Cl.[3] ..... F25D 23/12

[52] U.S. Cl. ..... 62/262; 98/94.2; 62/285

[58] Field of Search ..... 62/262, 285; 98/94 AC, 98/DIG. 10; 165/122

[56] References Cited

U.S. PATENT DOCUMENTS 4,205,597 6/1980 Nawa et al. ..... 62/262 X
4,416,327 11/1983 Nakada et al. ..... 62/262 X

FOREIGN PATENT DOCUMENTS 1095132 12/1967 United Kingdom .
1283281 7/1972 United Kingdom .
2060866A 5/1981 United Kingdom .
2074717A 5/1982 United Kingdom .

OTHER PUBLICATIONS

Matu—Q74+Q57 E3157Y/21=US 4,148,333.
Carg Q75+Q74 B4829Y/o7 ZA 7600-904.

*Primary Examiner*—Henry Bennett
*Attorney, Agent, or Firm*—Oblon, Fisher, Spivak, McClelland & Maier

[57] ABSTRACT

A single-body type air conditioner in which a casing and a base plate held in the casing are defined by an intermediate partition to form a room side section and an outdoor side section; a heat exchanger and a fan are placed in each of the sections; a driving motor is positioned to drive the fans; an air blowing passage is formed below the room side heat exchanger and an air intake grille is formed at the upper part and an air blowing louver is formed at the lower part of a front panel. Air blowing in the vertical and lateral direction is attainable as desired.

6 Claims, 16 Drawing Figures

FIGURE 1 *PRIOR ART*
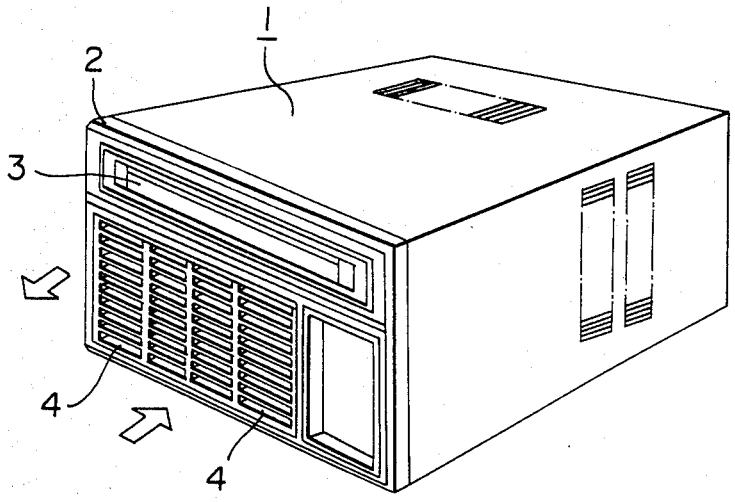
FIGURE 2 *PRIOR ART*
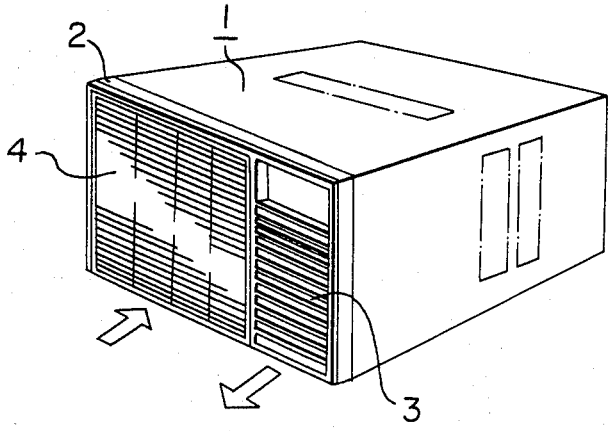

ONE-BODY TYPE AIR CONDITIONER

The present invention relates to the construction of an air passage of a single-body type air conditioner installed by fitting it in a perforated wall or window of a room to be air-conditioned.

The conventional single-body type air conditioner is classified into two types: an upper diffusion type air conditioner in which a front panel 2 closing the front side of a casing 1 is composed of an upper air-flowing louver 3 and a lower air-intake grille 4 as shown in FIG. 1 and a side diffusion type air conditioner in which a front panel 2 closing the front side of a casing 1 is composed of an air blowing louver 3 formed at its one side and an air intake grille 4 at the other side as shown in FIG. 2.

In case of the upper diffusion type air conditioner, if it is installed at the height in a room as shown in FIG. 7C, air stream passes near the ceiling and does not reach a resident. Even though the resident upsets the louver to direct air downward, there occurs a short cycle phenomenon that blown air is sucked into the air intake grille with the consequence that air conditioning in a residential space is insufficient.

In case of the side diffusion type air conditioner having the air blowing louver and the air intake louver at the right and left sides of the front panel, when the air blowing louver is turned toward the air intake grille side, blown air is sucked into the air intake grille resulting in the short cycle as seen in the upper diffusion type air conditioner (FIG. 7D).

As a result, it is only possible to direct air in a limited direction in a residential space. Accordingly, when the air conditioner of this type is installed in the middle of a wall, there occurs unevenness of air blowing in a room thereby causing an uneven temperature distribution in the residence space.

It is an object of the present invention to overcome the disadvantages of the conventional air conditioner and to provide a single-body type air conditioner which minimizes unevenness of temperature distribution in a residential space.

The object of the present invention is to provide a single-body type air conditioner which comprises a casing, a base plate placed in the casing, an intermediate partition which defines the casing and the base plate to form a room side section and an outdoor side section, a heat exchanger and a fan placed in each of the sections, a driving motor having a shaft extending on both sides to which the fans are respectively secured, an air blowing outlet formed below the room side heat exchanger and an air intake grille and an air blowing louver respectively formed in the upper and lower parts of the front panel of the casing. With the construction of the air conditioner described above, it effectively operates without causing a short cycle even installed at the height in a room and without deflecting the air blowing louver downward. Even when it is installed at a lower portion, a satisfactory effect can be obtained by directing an air blowing direction-controlling louver slightly upward. The air conditioner is made to contribute to improvement in cooling effect by lengthening the distance that an air stream extends and providing uniform blowing of air in the right and left portions of a room by periodically changing the air flow to the right and left so as to give a uniform temperature distribution. It is also possible that a large amount of air is directed to one side rather than to the other. Furthermore, the air conditioner has an air blowing passage which reduces air flow resistance and is so designed as to reduce noise and also provide a superior cooling effect in comparison with the conventional air conditioners having the same rated capacity.

BRIEF DESCRIPTION OF THE DRAWINGS

The foregoing object, other objects as well as specific construction and function of the single-body type air conditioner of the present invention will become more apparent and understandable from the following detailed description thereof, when read in conjunction with the accompanying drawings wherein:

FIG. 1 is a perspective view of a first conventional single-body type air conditioner of an upper diffusion type;

FIG. 2 is a perspective view of a second conventional single-body type air conditioner of a side diffusion type;

FIG. 13 is a cross sectional view similar to FIG. 9 of a second embodiment of the present invention.

DETAILED DESCRIPTION OF THE PREFERRED EMBODIMENTS

Figure 3:
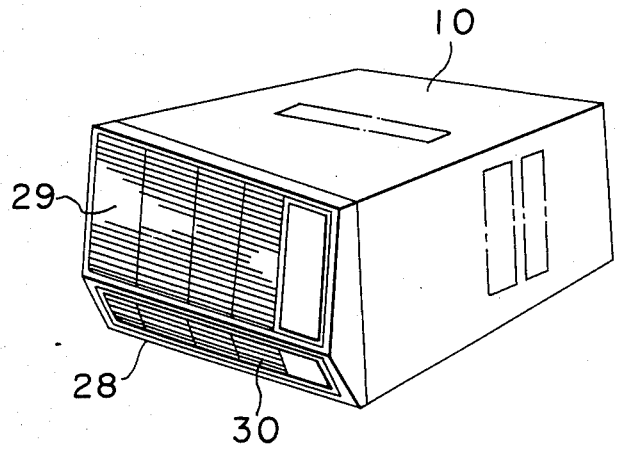
FIG. 3 is a perspective view of an embodiment of the single-body type of the present invention.
Figure 4:
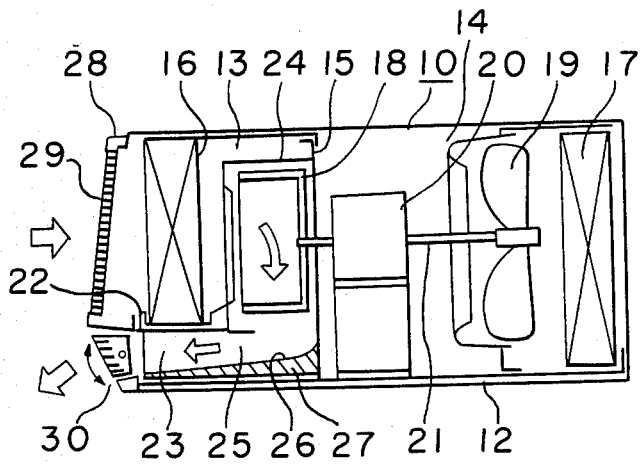
FIG. 4 is a longitudinally sectional view of the air conditioner shown in FIG. 3.

An embodiment of the single-body type air conditioner of the present invention will now be described in detail with reference to FIGS. 3 and 5.

Reference numeral 10 designates the casing of a single-body type air conditioner having front and rear openings. The casing 10 holds a base plate 12 on its bottom surface and has an intermediate partition 15 to separate the interior of casing into a room side section 13 and an outdoor side section 14. A room side heat exchanger 16 is positioned near the air intake grille 29 in the room side section 13 and an outdoor side heat exchanger 17 is positioned in the outdoor side section 14. There are provided in the casing 10 a room side fan 18 constituted by a Sirrocco fan and an outdoor side fan 19 constituted by a propeller fan, each being supported by each end of the shafts 21 extending both sides of a driving motor 20 fixed on the base plate 12 in the outdoor side section 14. A drain pan 22 is held below the room side heat exchanger 16. An air blowing passage 23 is formed below the room side heat exchanger 16. A fan casing 24 for the room side fan 18 is so arranged to cover the outdoor side fan 18 at the rear side of the room side heat exchanger 16. The reference numeral 25 designates a horizontally oriented room side air passage which is provided with a horizontally oriented air passage wall 26, in a gradually decreasing curved shape, continued from the intermediate partition 15 so as to communicate the fan casing 24 with the air blowing passage 23. A heat insulator 27 which serves also as a sound absorber made of a synthetic resin is interposed between the air passage wall 26 and the base plate 12. A front panel 28 for closing the front side of the casing 10 is provided with an air intake grille 29 at the upper portion and an air blowing louver 30 at the lower portion.

Figure 5:
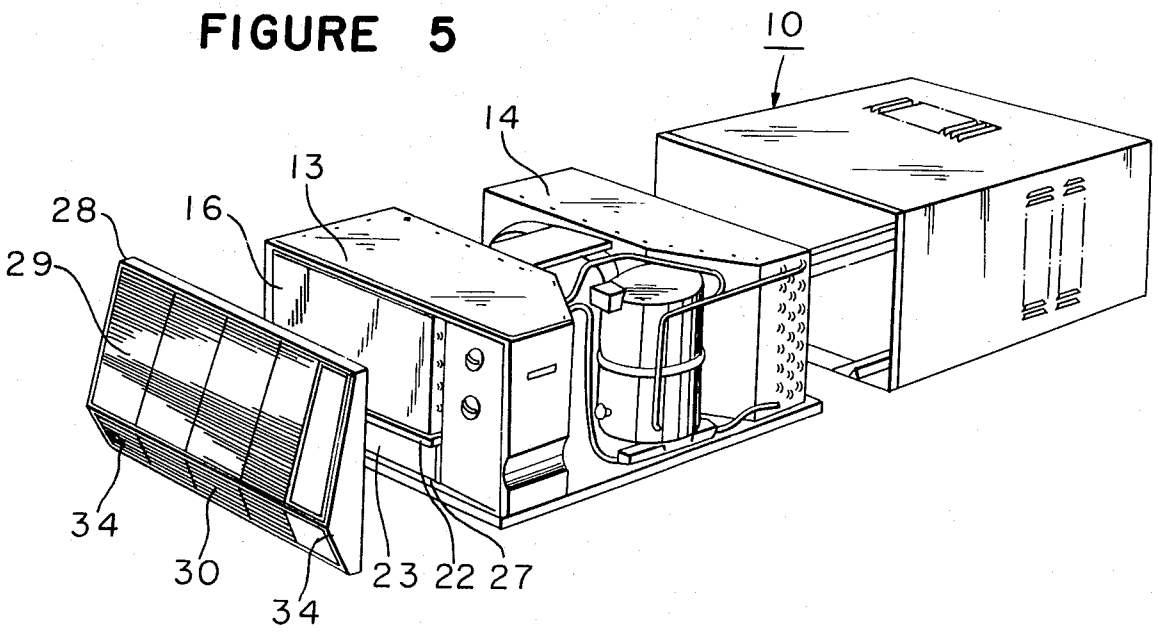
FIG. 5 is a perspective view in a disassembled state of an embodiment of the single-body type air conditioner of the present invention.
Figure 6:
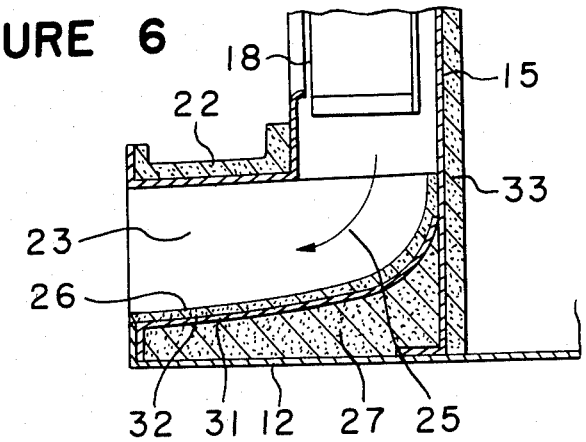
FIG. 6 is a perspective view partly broken of an embodiment of the air blowing circuit as an important part of the air conditioner according to the present invention.

FIG. 5 is a perspective view in a disassembled state of the one-body type air conditioner of the present invention and FIG. 6 is an enlarged view partly broken showing the air blowing passage which is an important part of the present invention.

In FIG. 6, the air passage wall 26 is made of a material such as steel plate 31, as is the intermediate partition 15, to give rigidity and a soft damping sheet 32 is attached on the inner surface of the air passage 23 to dampen a shock caused by impinging of air fed by the fan 18. On almost the whole surface of the intermediate partition 15, an insulating material 33 is attached to prevent thermal conduction into the room side air passage 25 from the outdoor side section.

The operation of the air conditioner of the present invention will be described with reference to FIGS. 3 to 6.

Air in a room sucked from the air intake grille 29 is fed, as shown by the arrow mark, by the function of the room side fan 18 to the room side heat exchanger 16 where the air is subjected to cooling and drying treatment and the thus treated air is further fed by the fan 18 into the room side air passage 25 formed at the lower part of the casing and is recycled to the room through the air blowing louver 30. In the course of recycling air, the air fed by the fan 18 strongly impinges the air passage wall 26 and the air flow is changed from a downward direction to the traverse direction. At this moment, there occurs flow resistance due to whirling stream which causes noise. In the air conditioner of the present invention, the damping sheet 32 is provided on the air passage wall 26 so that occurrence of noise caused by the impinging of the air is reduced. Furthermore, the air passage wall 26 is so formed as to be smoothly curved from the downward direction to the traverse direction with the result that air is smoothly fed to reduce the whirling of air when changed its direction, thereby suppressing the noise.

Figure 7B:
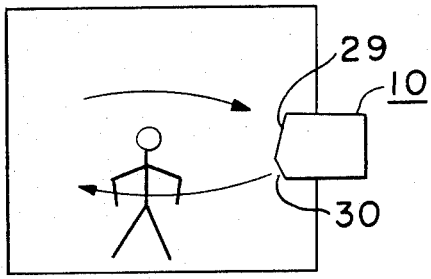
FIGS. 7A and 7B are respectively schematic views showing how the single-body type air conditioner of the present invention operates.
Figure 7A:
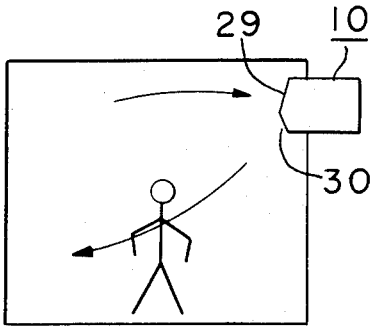
Figure 7D:
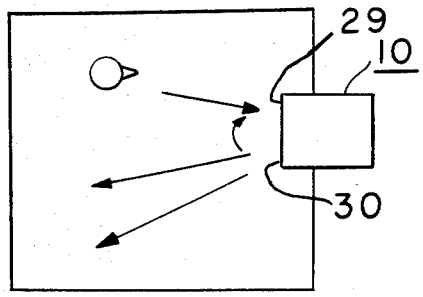
FIGS. 7C and 7D are, respectively, schematic views of the conventional single-body type air conditioners showing how the devices operate.
Figure 7C:
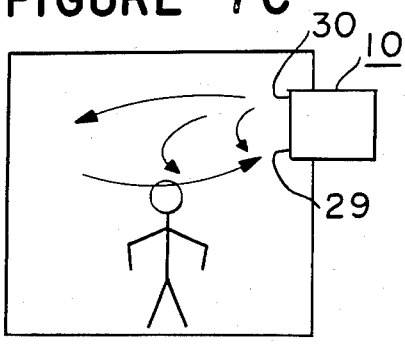

With reference to FIGS. 7A and 7B, a discussion will now be made as to how the one-body type air conditioner of the present invention desirably operates when installed at a higher or lower position and prolongs an air-extending distance, hence improving the temperature distribution in a room.

FIG. 7A schematically shows that air is fed toward a resident from the air conditioner casing 10 installed at the height of a room by adjusting the air blowing louver 30 so as to direct slightly downward, thereby being obtainable an effective cooling function in the room.

FIG. 7B schematically shows operation of the air conditioner where it is installed at a louver position in a room. Air is blown toward a resident by adjusting the air blowing louver 30 to face front or slightly upward. When the air conditioner is installed at the lower portion in a room, it is usually to put the air conditioner on the louver window frame. Accordingly, the front side of the air blowing louver 30 faces a residence area so that it is unnecessary to deflect the position of the air blowing louver 30 extremely upward, i.e. the air intake grille side. In such case, there occurs no short cycle and an effective cooling function can be obtained.

An embodiment of the air blowing louver 30 shown in FIG. 3 which is an important part of the present invention will be described with reference to FIGS. 8 to 12.

Figure 8:
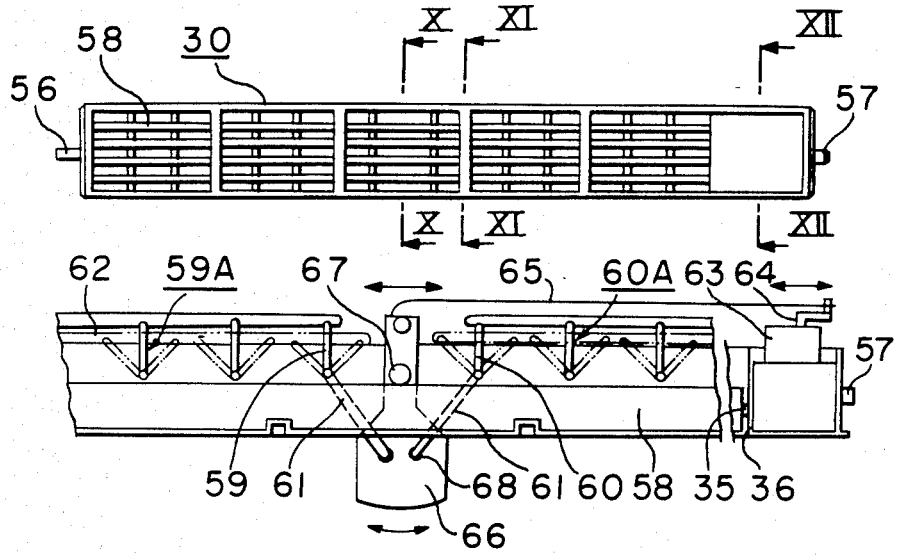
FIG. 8 is a front view showing an important part of the air conditioner of FIG. 3.

The air blowing louver 30 has pivotal shafts 56, 57 projecting from both sides thereof as shown in FIG. 8. The pivotal shafts are pivotally fitted into holes formed in the inner surface of both side walls 34 of the front panel 28 in a vertically swinging manner so that air blowing direction is vertically changed. The air blowing louver 30 is further provided with a plurality of vertically air-feeding plates 58, each provided with pivotal shafts 35 at both sides of the plate, which are respectively supported horizontally by the air blowing louver 30 so as to be turnable around the pivotal shafts 35 by fitting them into holes formed in the inner side walls 36 of the air blowing louver 30. Thus, the vertically air-feeding plates 58 are adapted to change air blowing direction in vertical direction. A plurality of air-feeding and movable plates 59, 60 are provided at the rear and in the vicinity of the vertically air-feeding plates 58. The laterally air-feeding and movable plates 59, 60 are respectively provided with vertically extending pivotal shafts 37 formed in one-piece with the plate and are turnably supported by the air blowing louver 30 by fitting the pivotal shafts 37 into holes formed in upper and lower frames 38 of the air blowing louver 30. The plurality of movable plates 59 constitute a group of leftward laterally air-feeding and movable plates 59A and the plurality of movable plates 60 constitute a group of rightward laterally air-feeding and movable plates 60A. Both the movable plate groups 59A and 60A are placed at both sides with respect to the center of the air blowing louver 30.

Figure 11:
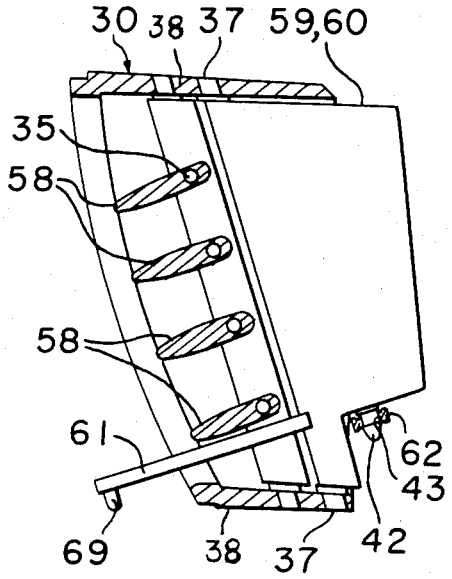
FIG. 11 is a cross sectional view taken along line XI—XI of FIG. 8 in which a movable plate is removed.
Figure 12:
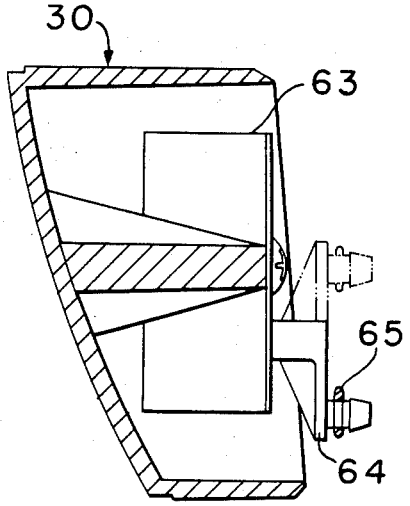
FIG. 12 is a cross sectional view taken along line XII—XII of FIG. 8.

As shown in FIG. 11, each of the movable plates 59, 60 has in its lower part a connecting shaft 42 at a position apart from the pivotal shaft 37 and the movable plate groups 59A and 60A are respectively connected to connecting bars 62 by fitting the connecting shafts 42 to corresponding through holes 43 formed in the connecting bar 62. Among the groups of movable plates 59A, 60A, the movable plates 59, 60 which are placed nearmost the center of the air blowing louver 30 are respectively provided with an arm 61 projecting forwardly and a boss 69 is formed at the lower end of the arm 61.

The air blowing louver 30 has at its central portion a movable plate 66 which is pivotally supported by a pivotal pin 67. A pair of holes 68 is formed in the movable plate 66 at positions apart from a given distance from the pivotal pin 67 and each of the boss 69 is fitted into each hole 68.

As shown in FIGS. 9 to 12, at one side of the air blowing louver 30, there is provided a motor 63 connected with a crank 64 at the rear part of the motor. A rod 65 connects the crank 64 to the rear end of the movable plate 66.

The operation of the air blowing louver 30 will be described with reference to FIGS. 8, 9 and 10. Adjustment of air blowing in the vertical direction is carried out by turning the air blowing louver 30 around the pivotal shafts 56, 57 and furthermore, by shifting the vertically air-feeding plates 58 upward or downward. Thus, two stages of vertical adjustment of air blowing can be attained. Adjustment of air blowing in the lateral direction is carried out by actuating the motor 63 positioned at one side of the air blowing louver 30 to rotate the crank 64. The revolution of the crank causes the rod 65 reciprocating movement whereby the movable plate 66 is subjected to continuously reciprocating movement with respect to the pivotal pin 67. The reciprocating movement of the movable plate 66 is transmitted to the groups of the movable plates 59A, 60A through the respective arms 61 with the result that the air blowing direction is changed.

Thus, the air blowing louver 30 of the present invention allows adjustment of air blowing in the vertical and lateral directions and, more particularly, allows automatic adjustment in the lateral direction to thereby eliminate bothersome operation. Furthermore, it provides a uniform air blowing in a room for saving energy.

Figure 9:
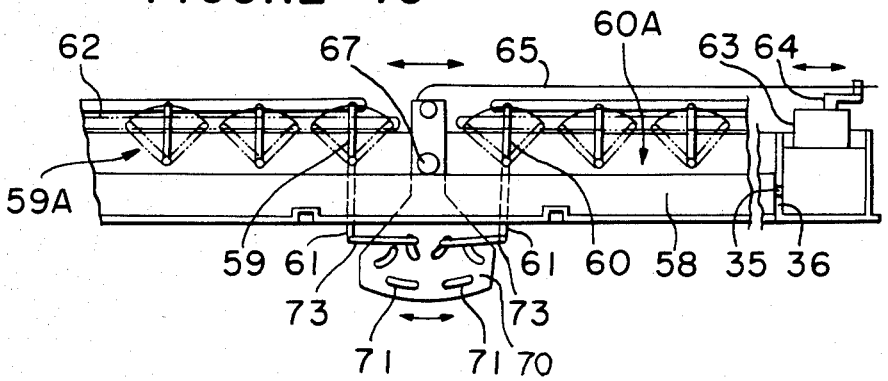
FIG. 9 is a cross sectional view taken along a horizontal line of FIG. 8.
Figure 10:
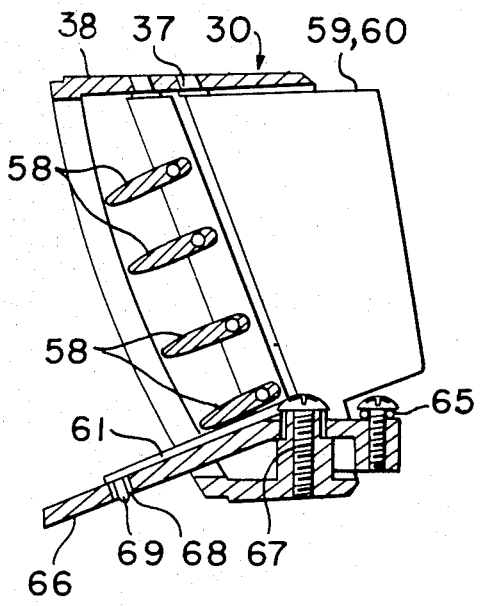
FIG. 10 is a cross sectional view taken along line X—X of FIG. 8.

Another embodiment of the air blowing louver 30 is shown in FIG. 13 in which a number of holes 71 are formed in a movable plate 70 instead of the movable plate 66 shown in FIG. 9. By selecting desired holes 70, swinging angle of the laterally air-feeding and movable plates 59, 60 can be changed or it is possible to deflect the swing angle of the movable plates. In FIG. 13, the reference numerals as in FIG. 9 designate the same or corresponding parts and therefore, the description is omitted. The holes 71 in the movable plate 70 are formed to have different distance from the pivotal pin 67 each other and the bosses 69 of the arm 61 attached to the movable plates 59, 60 are respectively fitted to the hole 71 as desired. The arm 61 has a hinged portion 73 at its intermediate portion in a bendable manner so that connection of the boss 69 to the hole 71 is easy. By adequately selecting the hole 71 to be connected with the arm 61, the direction of the movable plate groups 59A, 60A is changed depending on the positional relationship of the pivotal shaft 37 to the hole 71. The swinging angle of the movable plate groups 59A, 60A is changeable by suitably selecting the hole 71. In this case, the distance from the hole to the pivotal pin 67 of the movable plate 70 is changeable depending on the length of the hole 71.

As described above, a single-body type air conditioner of the present invention is so constructed that a casing holding a base plate is defined by an intermediate partition to form a room side section and an outdoor side section; a heat exchanger and a fan are provided in each of the sections; a driving motor is placed in the casing to drive the fans by its coaxial axis; an air blowing passage is formed below the heat exchanger placed in the room side section; an air intake grille is formed at the upper portion of the front panel of the casing and an air blowing louver is formed at the lower portion thereof. With the construction described above, the single-body type air conditioner of the present invention provides advantages that the air conditioner effectively operates when installed at the height in a room and also effectively operates by directing an air-blowing direction-controlling louver upwardly even in case of installation at a lower position and such contributes to improving the cooling effect by lengthening distance that an air stream extends, while minimizing the resistance in an air blowing passage and thus reducing the air flow loss. It is also so designed as to reduce noise and it provide a superior cooling effect in comparison with the conventional air conditioners having the same rated capacity.

What is claimed and desired to be secured by Letters Patent of the United States is:

1. A single-body type air conditioner; comprising:

a casing;

a base plate placed in said casing;

a front panel connected to said casing and having an air intake grille formed therein at an upper portion thereof;

an intermediate partition positioned in said casing to define a room side section and an outdoor side section;

a room side heat exchanger positioned in said room side section;

an outdoor side heat exchanger positioned in said outdoor side section;

a room side fan and an outdoor side fan positioned respectively adjacent said room side heat exchanger and said outdoor side heat exchanger;

a driving motor having first and second shafts extending first and second sides thereof, first and second ends of said shaft securing said room side fan and said outdoor side fan respectively;

a drain pan and an air blowing outlet positioned below said room side heat exchanger;

room side air blowing passage means located within said casing to communicate said air intake grille with said air blowing outlet and which further comprises an air passage wall for forming a lower part of said room side air passage formed unitarily with said intermediate partition; heat insulator means interposed between said air passage wall and said base plate; and a synthetic resin sound absorber and an air blowing louver located adjacent a lower portion of said front panel and which is placed downstream of said air intake opening and said air blowing outlet wherein said air blowing passage means and said air passage wall extend horizontally from said intermediate partition to said air blowing louver and wherein said air passage wall is of a gradually decreasing curved shape.

2. A single-body type air conditioner according to claim 1 wherein said air blowing louver further comprises a plurality of air deflecting plates for deflecting air in a vertical direction.

3. A single-body type air conditioner according to claim 2 wherein said plurality of air deflecting plates further comprise plate means allowing for normal preset adjustments.

4. A single-body type air conditioner according to claim 1 wherein said air blowing louver further comprises a plurality of plates for deflecting air in a lateral direction.

5. A single-body type air conditioner according to claim 4 which further comprises means for automatically moving said plurality of movable plates.

6. A single-body type air conditioner according to claim 5 further comprising means for manually presetting said movable plates.

* * * * *